US012723509B2

(12) United States Patent
Morgan et al.

(10) Patent No.: US 12,723,509 B2
(45) Date of Patent: Sep. 1, 2026

(54) SYSTEMS, METHODS AND APPARATUS FOR DOWNHOLE MONITORING OF PRODUCTION CONDITIONS USING EM TELEMETRY

(71) Applicant: GEO PSI PTY LTD, Wooloowin (AU)

(72) Inventors: Quentin Morgan, Brisbane (AU); Michael Siefert, Brisbane (AU)

(73) Assignee: GEO PSI PTY LTD, Wooloowin (AU)

( * ) Notice: Subject to any disclaimer, the term of this patent is extended or adjusted under 35 U.S.C. 154(b) by 0 days.

(21) Appl. No.: 19/116,210

(22) PCT Filed: Sep. 29, 2022

(86) PCT No.: PCT/AU2022/051169

§ 371 (c)(1),
(2) Date: Mar. 27, 2025

(87) PCT Pub. No.: WO2024/064991

PCT Pub. Date: Apr. 4, 2024

(65) Prior Publication Data

US 2026/0117647 A1 Apr. 30, 2026

(51) Int. Cl.

| | |
|---|---|
| ***E21B 47/13*** | (2012.01) |
| ***E21B 17/02*** | (2006.01) |
| ***E21B 17/043*** | (2006.01) |

(52) U.S. Cl.
CPC ..... *E21B 47/13* (2020.05); *E21B 17/0285* (2020.05); *E21B 17/043* (2013.01)

(58) Field of Classification Search
CPC ..... E21B 47/13; E21B 17/0285; E21B 17/043
See application file for complete search history.

(56) References Cited

U.S. PATENT DOCUMENTS

| | | | | |
|---|---|---|---|---|
| 11,454,095 | B1 * | 9/2022 | Gajic | E21B 41/0085 |
| 2002/0075114 | A1 * | 6/2002 | Hall | E21B 17/003 336/192 |
| 2005/0001738 | A1 * | 1/2005 | Hall | E21B 47/13 340/854.8 |
| 2005/0284663 | A1 * | 12/2005 | Hall | E21B 47/13 175/48 |
| 2008/0074226 | A1 * | 3/2008 | Hall | E21B 47/13 336/96 |
| 2009/0078426 | A1 * | 3/2009 | Blaquiere | E21B 43/126 166/105 |

(Continued)

OTHER PUBLICATIONS

International Search Report and Written Opinion in related application PCT/AU2022/051169 dated Dec. 14, 2022.

*Primary Examiner* — Amine Benlagsir
(74) *Attorney, Agent, or Firm* — Patterson + Sheridan, LLP

(57) ABSTRACT

A gap sub for wellbore fluids comprises an electrical isolation structure to electrically isolate two metallic ends of the gap sub and a housing mounted outside of the gap sub. The housing accommodates an "external gap" and a toolstring for acquiring in-situ measurements of wellbore and near-wellbore conditions and transmitting the measurements to surface using EM telemetry. The gap sub comprises an antenna rod connected to the "external gap", the antenna rod straddling the electrical isolation structure in the gap sub to be electrically isolated from one metallic end of the gap sub and electrically coupled to the other metallic end of the gap sub.

21 Claims, 5 Drawing Sheets

(56) References Cited

U.S. PATENT DOCUMENTS

| | | | | |
|---|---|---|---|---|
| 2011/0107834 | A1* | 5/2011 | Howard | E21B 43/08 73/431 |
| 2011/0284216 | A1* | 11/2011 | Addis | E21B 17/0283 166/250.01 |
| 2013/0186641 | A1* | 7/2013 | Lovell | E21B 47/13 166/380 |
| 2014/0266210 | A1* | 9/2014 | Godager | G01V 3/24 340/854.8 |
| 2016/0003035 | A1* | 1/2016 | Logan | H04B 3/54 340/854.6 |
| 2018/0135408 | A1* | 5/2018 | Cooley | E21B 41/0085 |
| 2018/0210107 | A1* | 7/2018 | Donderici | E21B 47/26 |

* cited by examiner

SYSTEMS, METHODS AND APPARATUS FOR DOWNHOLE MONITORING OF PRODUCTION CONDITIONS USING EM TELEMETRY

FIELD OF THE INVENTION

The present invention relates to technology useful in wireless monitoring of in-situ conditions in conventional and unconventional oil and gas production and monitoring wells. In particular, but not exclusively, the present invention relates to an electrically insulating, gap sub assembly, used for electromagnetic telemetry between surface and subsurface locations, wherein the sensors, electronics and power source are self-contained in a pressure-tight housing, filled with air or inert gas, outside the gap sub.

BACKGROUND TO THE INVENTION

Ultra-low frequency (ULF) electromagnetic (EM) waves are the preferred transmission mechanism for wireless subterranean telemetry applications due to the ULF wave's ability to propagate long distances through the Earth's strata. In a typical subterranean telemetry application, the desired telemetry information is digitally encoded into data packets and sent as modulated "bursts" of ULF carrier waves. Transmission of the carrier waves is physically facilitated by injecting a modulated current into the Earth media using a power amplifier to create a time-varying voltage potential between two transmit electrodes coupled to the Earth media.

The electrodes are spaced such that the induced current traverses a section of the Earth media creating associated electric and magnetic field energy which radiates as time-varying wave fronts through the Earth media.

According to a conventional EM telemetry system a lower portion of a drill string in an open hole portion of the well is electrically isolated from the upper portion, a part of which is situated in open hole also, permitting the electrically-isolated lower portion to act as an antenna to transmit or receive ULF carrier waves to or from the surface through the Earth's strata. Transmission and reception by the antenna is enabled by circuitry within an EM transceiver situated in a pressure-retaining housing located in the lower drill string portion below the point of electrical isolation. The EM transceiver housing is conventionally deployed in an antenna sub located just below the point of electrical isolation. In receive mode, the EM transceiver is connected to the lower drill string portion acting as an antenna that is electrically isolated from the surface. The EM transceiver may thus receive EM waves propagated from the surface through the Earth's strata. In transmit mode, the EM transceiver's tendency is to want to transmit using the entire drill string as an antenna. However, EM waves propagated by the transceiver are forced to "jump" the point of electrical isolation by passing through the surrounding Earth media. In so doing, the EM waves are thus forced to propagate through the Earth's media, where they may be received by the surface antennae. The EM system may therefore enable tools on the drill string to intercommunicate with the surface via encoded data packets modulated onto the transceived carrier waves.

In order for the lower drill string portion to efficiently function as an antenna, the lower portion should be electrically isolated from the upper portion as completely as possible. Any loss in complete electrical isolation will cause the lower drill string to start to lose its character as an antenna, reducing the effectiveness of the EM system in communicating via the Earth's strata. This need for as complete electrical isolation as possible is magnified in view of the "reality" of the high impedance of the Earth's strata through which the carrier waves must pass in normal operational mode. In order to encourage robust wave propagation through the Earth's strata (and deter wave propagation losses to ground via the upper portion of the drill string), the impedance of the electrical isolation must be correspondingly even higher. It will be appreciated that complete electrical isolation is rarely achievable in practice. Most operational isolations will be "lossy" to some degree. A goal of electrical isolation of the drill string in EM telemetry is thus to reduce "lossiness" to as close to "no losses" as possible.

At and around the desired point of isolation, the drill string often comprises an operational downhole tool structure deployed inside a hollow cylindrical outer collar. The collar generally refers to a string of concatenated hollow tubulars made from non-magnetic material, usually stainless steel. In this type of deployment, it is often advantageous to make separate but cooperating electrical breaks in both the tooling and in the collar itself in order to achieve overall electrical isolation of the entire drill string.

This electrical isolation of the upper and lower portions of the drill string is frequently enabled by placement of "gap sub" technology in the drill string at the point at which isolation is desired. The gap sub technology provides isolating structure to prevent, as completely as possible, any electrical conductivity through the drill string between the portions of the drill string above and below the gap sub technology.

In a typical embodiment, a "gap sub" is provided, comprising a hollow tubular inserted in the concatenation of hollow drill collar tubulars. The concatenated connections of the drill collar tubulars are conventionally pin and box threaded connections, and the drill collars are conventionally a non-magnetic material (usually stainless steel). The gap sub is conventionally a non-magnetic tubular with pin and box connections at either end, configured to be inserted at a desired position in a concatenated string of similarly-connected non-magnetic drill collar tubulars. The drill collars form a portion of the overall drill string. Functionally, therefore, the gap sub electrically isolates the portions of the drill collar (and therefore, by extension, the entire drill string) above and below the gap sub.

Similarly, inside the drill collars, an "internal gap" is used for electrical isolation within the internal tooling structure. It is usually positioned just above the EM transceiver tool, which is connected to other tools, comprising sensors and electronics inside one or more pressure housings. The EM transceiver tool and other tools collectively form a "toolstring". The internal gap electrically isolates the tools within the toolstring below the internal gap from the tools within the toolstring above the internal gap. Advantageously, the internal gap is also positioned as close to the external gap sub as is feasible, in order not to separate the internal gap and external gap too far within the drill string. When internal and external gaps are separated, the quality of the "jump" of EM transmissions across the gap and into the surrounding formation may be compromised.

Prior art describes use of ceramic and composite isolation structures to create the internal and external gaps. While serviceable, ceramic embodiments have historically been known to gradually breakdown or fail, e.g. in high-vibration environments. Conversely, composite collars provide superior, almost complete electrical isolation, and have demonstrated excellent long-term reliability For traditional open hole drilling applications, it is necessary for the annular void between the inside of the gap sub and the outside of the toolstring to be filled with flowing drilling fluid to lubricate drilling operations and carry cuttings back to surface. The internal gap isolation must therefore also incorporate sealing arrangements to prevent wellbore fluids from flooding the toolstring. However, when using EM telemetry to transmit measurements acquired from inside wells after they have been drilled and completed to produce fluids, it is preferable to provide full-bore access through the gap sub. However, this is not possible when the toolstring is positioned inside the gap sub. Also, a toolstring positioned inside the gap sub will hinder fluid production rates. Another problem is that produced fluids inside the gap sub may have physicochemical properties that can expose a toolstring positioned inside the gap sub to corrosion, abrasion risk and/or erosion risk. Furthermore, if a submersible pump, driven by a rod string, is incorporated in the well completion design below the gap sub, the rod string will need to extend from the surface through the bore of the gap sub to the submersible pump.

OBJECT OF THE INVENTION

It is a preferred object of the present invention to provide a system, a method and/or an apparatus that address or at least ameliorates one or more of the aforementioned problems of the prior art and/or provides a useful commercial alternative.

Another preferred object of the present invention is to provide an improved gap sub design that accommodates the toolstring in its entirety inside a gas-filled void on the outside of the gap sub.

Another preferred object of the present invention is to provide full-bore access inside a gap sub for wellbore fluids, the gap sub incorporating an electrical isolation structure ("the gap") to electrically isolate two metallic ends of the gap sub, and the gap sub being of sufficient length to accommodate a toolstring, comprising one or more sensors, a EM transceiver and an electrical power source, entirely inside a housing mounted on the outside of the gap sub. The gap sub is incorporated between tubing joints in a tubing string at a desired depth in a well, with measurements acquired from the sensors inside the gap sub transmitted to surface using ULF EM telemetry.

SUMMARY OF THE INVENTION

Generally, the present invention relates to systems, methods and/or apparatus for acquiring in-situ measurements at the bottom of a well, with measurements transmitted to surface using EM telemetry, using a toolstring situated entirely within a pressure-tight, gas-filled housing mounted on the outside of a gap sub.

In one form, although not necessarily the broadest form, the invention resides in a gap sub for wellbore fluids, the gap sub comprising:

- an electrical isolation structure to electrically isolate two metallic ends of the gap sub;
- a housing mounted outside of the gap sub, the housing accommodating an integral "external gap" and a toolstring for acquiring in-situ measurements of wellbore and near-wellbore conditions and transmitting the measurements to surface using EM telemetry; and
- an antenna rod connected to the "external gap" in the housing, the antenna rod straddling the electrical isolation structure in the gap sub to be electrically isolated from one metallic end of the gap sub and electrically coupled to the other metallic end of the gap sub.

Suitably, the toolstring comprises: one or more electronic sensors able to measure the wellbore and near-wellbore conditions; an EM transceiver for encoding measurements from the sensors, modulating an EM waveform and transmitting the EM waveform to surface; and a power source, such as a battery pack, to provide electrical power to the sensors and the EM transceiver.

Suitably, the one or more electronic sensors are integrated with the EM transceiver in a single module or provided in separate modules that can be coupled together.

Suitably, the housing is in the form of a pressure housing comprising a pressure transducer at the upper end thereof.

Suitably, the "external gap" is in the form of an adjustable antenna isolator assembly adjustably accommodated at least partly within a lower end of the pressure housing.

Suitably, the adjustable antenna isolator assembly is attached to a first end of an electrically conductive antenna rod to electrically isolate it from the pressure housing and one end of the gap sub.

Suitably, a second end of the electrically conductive antenna rod is coupled to the other end of the gap sub via a conductive element.

Suitably, the gap sub provides full-wellbore access, with the pressure housing mounted on an exterior surface of the gap sub.

Suitably, the gap sub comprises upper and lower metal tubes and the electrical isolation structure is in the form of a hollow composite electrical isolation collar in between the upper and lower metal tubes.

Preferably, the gap sub comprises an assembly for creating an electrical connection between a transmit/receive line on the EM transceiver with one end of the gap sub.

Preferably, the gap sub comprises an assembly for establishing an electrical connection between a ground plane on the EM transceiver with the other end of the gap sub.

Suitably, the gap sub comprises threaded pin and/or box connections at either end, configured to be inserted at a desired position within a tubing string.

Preferably, the adjustable antenna isolator assembly is accommodated at least partly within the pressure sensor housing to enable fine adjustment of an axial position of the antenna isolator assembly in the pressure housing. Suitably, this is achieved with external threads on an outer collar of the antenna isolator assembly engaging with internal threads in the pressure housing.

Preferably, the pressure housing comprises one or more ports to bleed-off any trapped pressure inside the pressure housing when the gap sub is retrieved to surface. Suitably, the adjustable antenna isolator assembly comprises one or more seals, wherein adjustment of the axial position of the adjustable antenna isolator assembly in the pressure housing until the one or more seals clear the respective one or more ports provides a vent mechanism to bleed-off any trapped pressure inside the pressure housing.

Suitably, the module comprising the one or more sensors comprises a shoulder that presses against an internal lip of the pressure housing under wellbore fluid pressure to rigidly secure the toolstring inside the pressure housing.

Suitably, the gap sub comprises a thread locking compound applied to threads of the threaded pin and/or box connections to ensure torque rating of the gap sub equals or exceeds the torque rating of the tubing string above and below the gap sub.

In another form, the invention resides in a method of acquiring in-situ measurements of wellbore and near-wellbore conditions and transmitting the measurements to surface using EM telemetry, the method comprising:

providing a gap sub between tubing joints in a tubing string for wellbore fluids, the gap sub comprising an electrical isolation structure to electrically isolate two metallic ends of the gap sub;

mounting a housing outside of the gap sub, the housing accommodating a toolstring with the EM telemetry and an "external gap"; and connecting an antenna rod to the "external gap" to electrically isolate the antenna rod from one of the metallic end members, the antenna rod straddling the electrical isolation structure in the gap sub, with the other end of the antenna rod mechanically and electrically connected to the other metallic end member.

In a further form, the invention resides in a system to acquire in-situ measurements of wellbore and near-wellbore conditions and transmitting the measurements to surface using EM telemetry, the system comprising:

a gap sub between tubing joints in a tubing string for wellbore fluids, the gap sub comprising an electrical isolation structure to electrically isolate two metallic ends of the gap sub;

a housing mounted outside of the gap sub, the housing accommodating an "external gap" and a toolstring providing the EM telemetry; and an antenna rod connected to the "external gap", the antenna rod straddling the electrical isolation structure in the gap sub to be electrically isolated from one metallic end of the gap sub and electrically coupled to the other metallic end of the gap sub.

Further forms and/or features of the present invention will become apparent from the following detailed description.

BRIEF DESCRIPTION OF THE DRAWINGS

In order that the invention may be readily understood and put into practical effect, reference will now be made to preferred embodiments of the present invention with reference to the accompanying drawings, wherein like reference numbers refer to identical elements. The drawings are provided by way of example only, wherein.

Figure 1A:
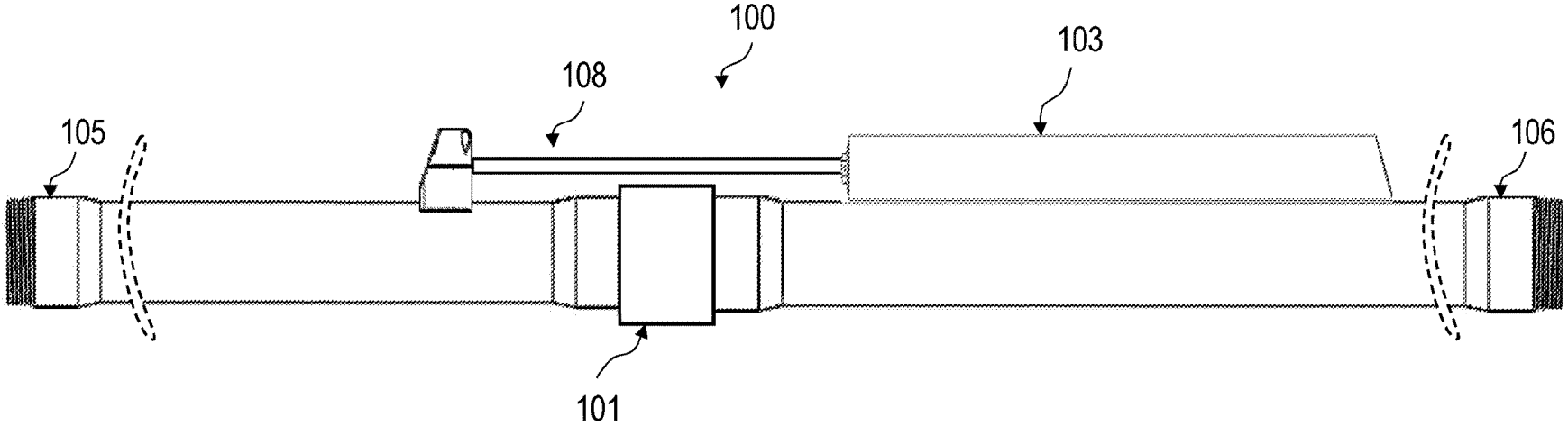
FIG. 1A is a diagram illustrating an apparatus according to one embodiment of the present invention.

Skilled addressees will appreciate that the drawings may be schematic and that elements in the drawings are illustrated for simplicity and clarity and have not necessarily been drawn to scale. For example, the relative dimensions of some of the elements in the drawings may be distorted to help improve understanding of embodiments of the present invention.

DETAILED DESCRIPTION OF THE INVENTION

Figure 1B:
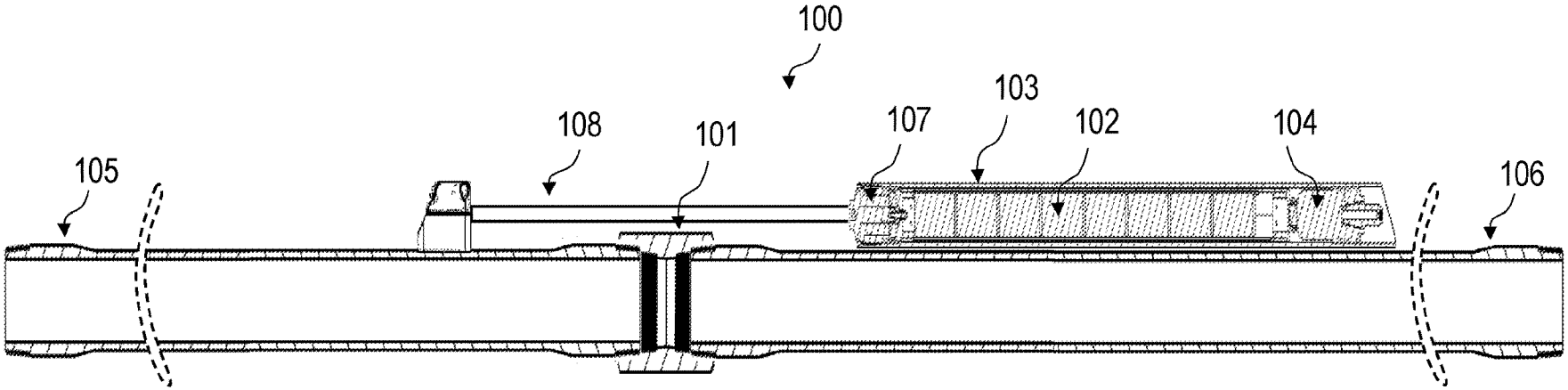
FIG. 1B is a cross sectional view of the apparatus shown in FIG. 1A.

The present invention relates to systems, methods and apparatus for acquiring in-situ measurements at the bottom of a well, with measurements transmitted to surface using EM telemetry, using a toolstring situated entirely within an air-tight gap sub FIG. 1 is a diagram of an apparatus 100 according to one embodiment of the invention. The apparatus comprises a hollow composite isolation joint 101 between metal end members 105 and 106, collectively referred to as the gap sub, with a toolstring 102, comprising electronic sensors, EM transceiver and battery pack, positioned inside a separate pressure housing 103 mounted on the outside of end member 106. The pressure housing 103 is connected to antenna rod 108, through an antenna isolator assembly 107, the purpose of which is to electrically isolate antenna rod 108 from end member 106. The antenna rod 108 straddles composite isolation joint 101, with the other end of the antenna rod 108 mechanically and electrically coupled to end member 105. The bore of the pressure housing 103 is isolated from wellbore fluids surrounding it by means of an antenna isolator assembly 107 and pressure and temperature transducer 104. Fully assembled, apparatus 100 is disposed to be inserted into a tubing string that is installed into the well to facilitate production of reservoir fluids to surface, or injection of fluids from surface into one or more reservoirs, or to monitor wellbore equipment or reservoir characteristics and properties. It will be appreciated that the orientation of apparatus 100 will in no way impact the ability of the EM transceiver to transmit modulated EM waveforms from downhole to surface, or receive EM signals from surface. As such, apparatus 100 can be inserted into the tubing string with end member 105 facing upwards or downwards, with end member 106 facing the opposite way.

Figure 2A:
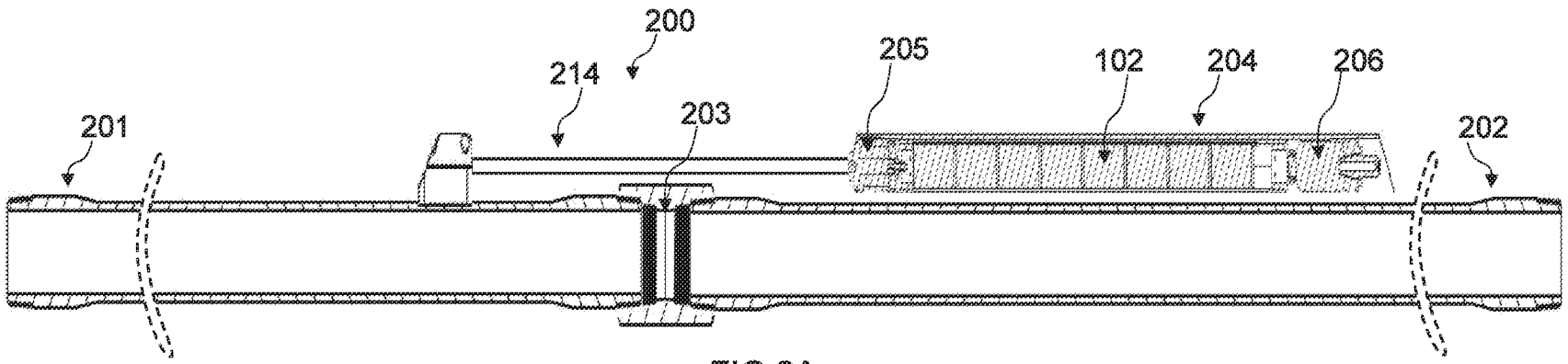
FIGS. 2A and 2B illustrate, in assembled and disassembled form respectively, cross-sectional views of a hollow composite isolation joint gap sub, including a non-conductive composite insert, shown in FIG. 1B.
Figure 2B:
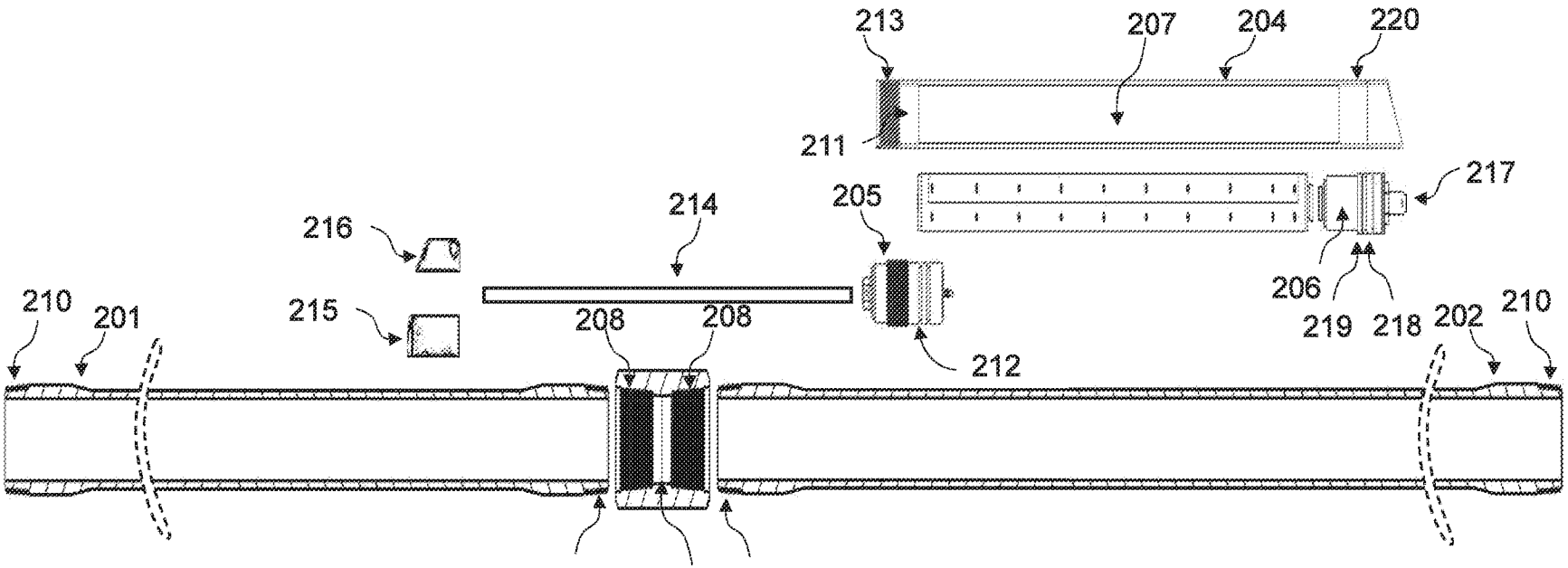

FIGS. 2A and 2B illustrate, in assembled and disassembled form respectively, cross-sectional views of one embodiment of a composite isolation joint gap sub 200. In FIG. 2A, gap sub 200 comprises pin end members 201 and 202 separated by an electrical isolation structure 203. A pressure housing 204, containing toolstring 102, is welded or affixed using other standard electrically conductive techniques to pin end member 202. Antenna isolator assembly 205 and pressure transducer 206 create a pressure seal, isolating the void 207 shown in FIG. 2B inside pressure housing 204 from wellbore fluids inside and outside the gap sub 200. The pin end members 201 and 202 are made from an electrically conductive material, which can be magnetic or non-magnetic. The electrical isolation structure 203 is a composite collar made from a non-conductive composite material, such as glass-fibre, although other non-conductive materials can be used, and the present invention is not limited in any way to use of this specific composite.

As noted, FIG. 2B illustrates gap sub 200 from FIG. 2A in disassembled form. All part numbers in FIG. 2A are illustrated in FIG. 2B by the same part number. FIG. 2B shows composite collar 203 including threaded box connections 208 at each end, configured to mate with threaded pin connections 209 at opposite end of threaded pin connections 210 on pin end members 201 and 202 to create a pressure-tight seal. A thread locking compound (not shown) is applied to threads 208 and 209 to increase torque rating. Suitable thread locking compounds include ForumLok from Forum Energy Technologies, although the present invention is not limited in any way to use of this specific compound.

Nothing in this disclosure should be interpreted to place any limitation on the size, shape, geometry or pin/box configurations of the threaded connections on 208, 209 or 210. It will be appreciated that the dimensional specifics of the threads may be varied to suit individual applications, responsive to parameters such as, for example, the dimensions and thicknesses of surrounding conductive portions, the electrical conductivity (or non-conductivity) and other electrical characteristics of the materials being used in the assembly, size and type of tubing used above and below the gap sub, the size and type of other equipment integrated into the tubing string above and below the gap sub, and/or the expected dynamic loads exerted on the gap sub in-situ. However, for exemplary guidance only, it has been observed that serviceable results may be obtained when the threaded connections 208, 209 and 210 are in a range of between 2 inches (5.08 cm) and 6 inches (15.24 cm) in length when the corresponding outside diameter of the assembly is in a range of between 2.5 inches (6.35 cm) and 6.5 inches (16.51 cm). It should also be obvious to the skilled addressee that threaded connections 208 and 209 can instead have pin and box configurations respectively, and that either of threaded connections 210 may have pin or box configurations, or both connections having the same box configuration also.

One or more ports 211 are included in pressure housing 204 that enables any build-up of gas pressure in the void space 207 inside the housing to be vented to the outside in a safe and controlled manner when the gap sub is retrieved to surface. This is achieved by backing out the threaded antenna isolator assembly 205 until seals 212 clear ports 211. The position and length of the internal threads 213 in pressure housing 204 is set to ensure that the pressure housing 204 is still engaged to these threads when seals 209 clear ports 208.

Adjustable antenna isolator assembly 205 is attached to electrically conductive antenna rod 214, using either a threaded or pinned connection. The adjustable antenna isolator assembly 205 electrically isolates antenna rod 214 from pin end member 202. The rod can be hollow or solid. The other end of antenna rod 214 is mechanically and electrically coupled to pin member 201 by sandwiching the rod between a metallic clamp block base 215, which is welded to pin end member 201, and a clamp block cap 216, which is bolted to the clamp block base 215. The clamp block cap 216 is made from an electrically non-conductive composite material, such as glass-filled PA66, although other non-conductive materials can be used, and the present invention is not limited in any way to use of this specific composite.

Pressure transducer 206 senses wellbore pressure surrounding pressure housing 204 via the hollow pressure port adapter 217. Multiple seals 218 on the pressure transducer 206 prevent wellbore fluid from entering the internal void 207 between the pressure transducer and adjustable antenna isolator assembly 205. Pressure transducer 206 also incorporates a shoulder 219 that presses against internal lip 220 on the inside of the pressure housing 204 due to action of wellbore fluid pressure on the end face of pressure transducer 206. Pressure transducer 206 is secured in place by means of a circlip 221. The circlip could be replaced with a threaded lock ring (not shown) instead to press pressure transducer 206 against internal lip 220.

Figure 3:
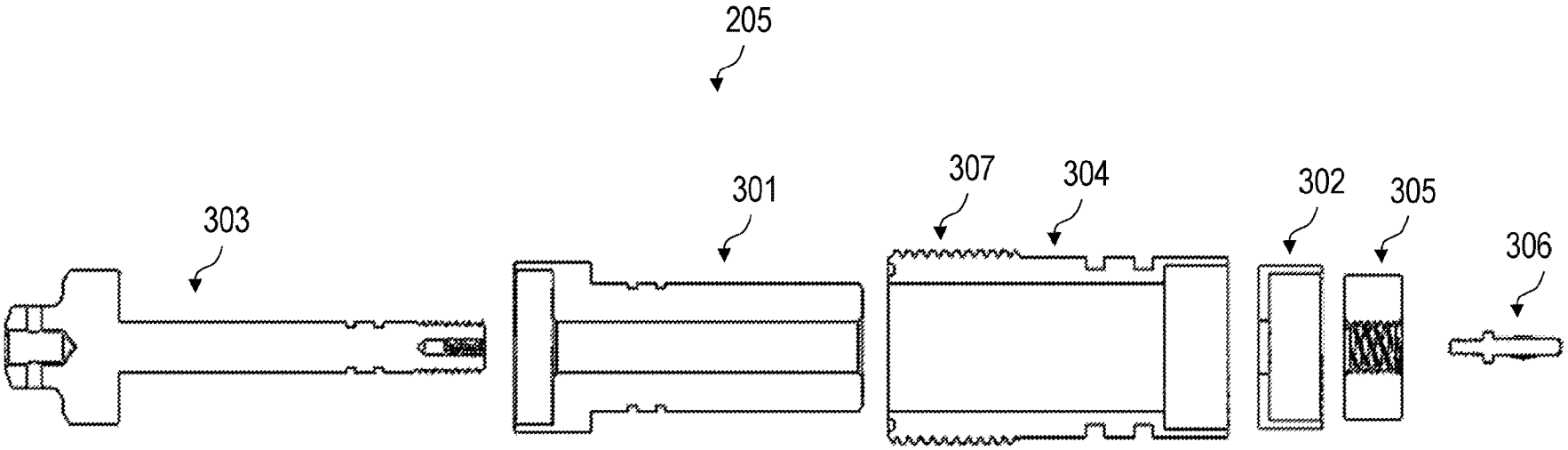
FIG. 3 is an exploded view of an adjustable antenna isolator assembly.

FIG. 3 illustrates the parts of the adjustable antenna isolator assembly 205 that constitutes an "external gap". The outer gap isolator liner 301 and outer gap isolator washer 302 are made from electrically non-conductive composite material, such as glass-filled PA66, thereby ensuring there is no electrical contact between antenna rod 214 and pressure housing 204. The outer gap stem 303, outer gap adjustment collar 304 and nut 305 are metallic, thereby ensuring there is electrical contact between the antenna rod 214 and toolstring 102, via banana pin 306. External threads 307 on outer gap adjustment collar 304 engage internal threads 213 in pressure housing 204 to enable axial position of the adjustable antenna isolator assembly 205 to be finely adjusted to accommodate slight variations in the length of the toolstring 102 due to cumulative tolerances in length of individual sections shown in FIG. 4. The adjustment feature also allows a slight compressive force to be applied to the toolstring 102 to ensure there is no intermittent loss of electrical contact with pin end members 201 and 202 respectively.

Figure 4:
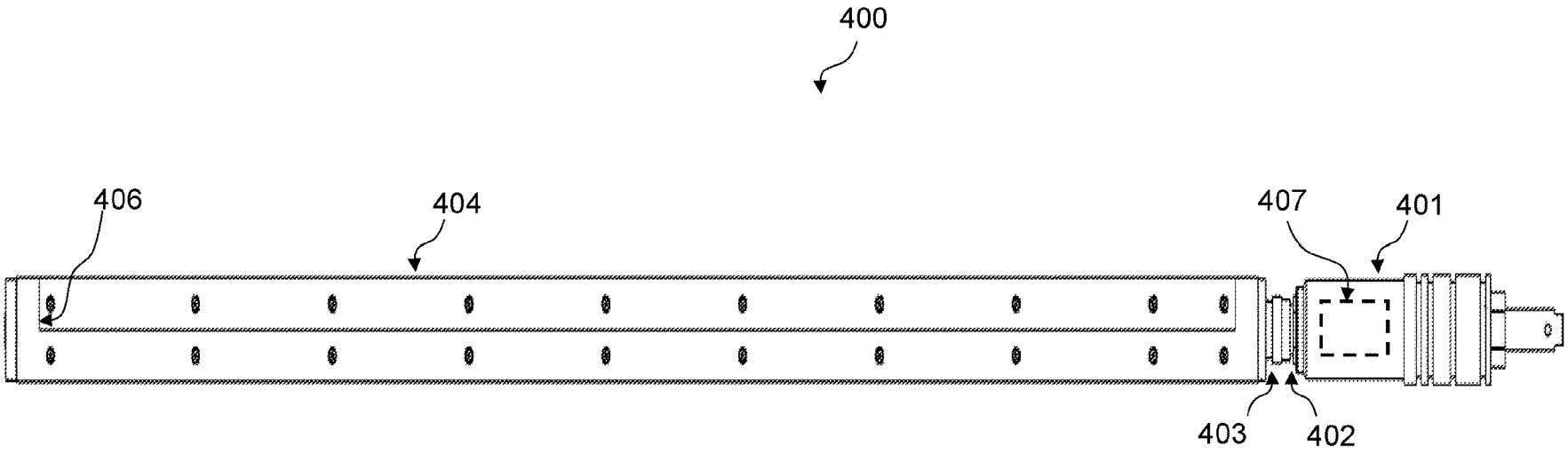
FIG. 4 is a diagram of the toolstring shown in FIG. 1B.

FIG. 4 shows an example toolstring 400. It comprises a pressure and temperature transducer 401 with a multi-pin electrical connector 402 that attaches to a mating multi-pin electrical connector 403 at one end of battery carrier 404. For compactness, pressure and temperature transducer 401 incorporates the EM transmitter and receiver circuitry 407 to send and receive encoded EM signals. The battery carrier 404 houses individual cells, connected in series and parallel as required, and is manufactured from an electrically insulating material, such as plastic. Alternatively, the interconnected cells can be shrouded in a sleeve also made from an electrically insulating material, such as rubber. Both insulating methods fulfill the function of an "internal gap", but not possessing any mechanical strength or containing any seal arrangements required of traditional "internal gaps" described previously. An electrical antenna wire 405 (not shown) extends from the EM transceiver circuitry inside pressure and temperature transducer 401 through the mating multi-pole connectors 402 and 403 and along the length of the battery carrier 404 and terminates into electrical socket 406 at the other end of battery carrier 404. The electrical socket 406 engages with electrical pin 306 in the adjustable antenna isolator assembly 205. EM signals generated by the EM transceiver circuitry 407 are transmitted along the antenna wire 405 and injected into pin end member 202 of gap sub 200, via metallic components of adjustable antenna isolator assembly 205, antenna rod 214 and clamp block base 215.

Figure 5:
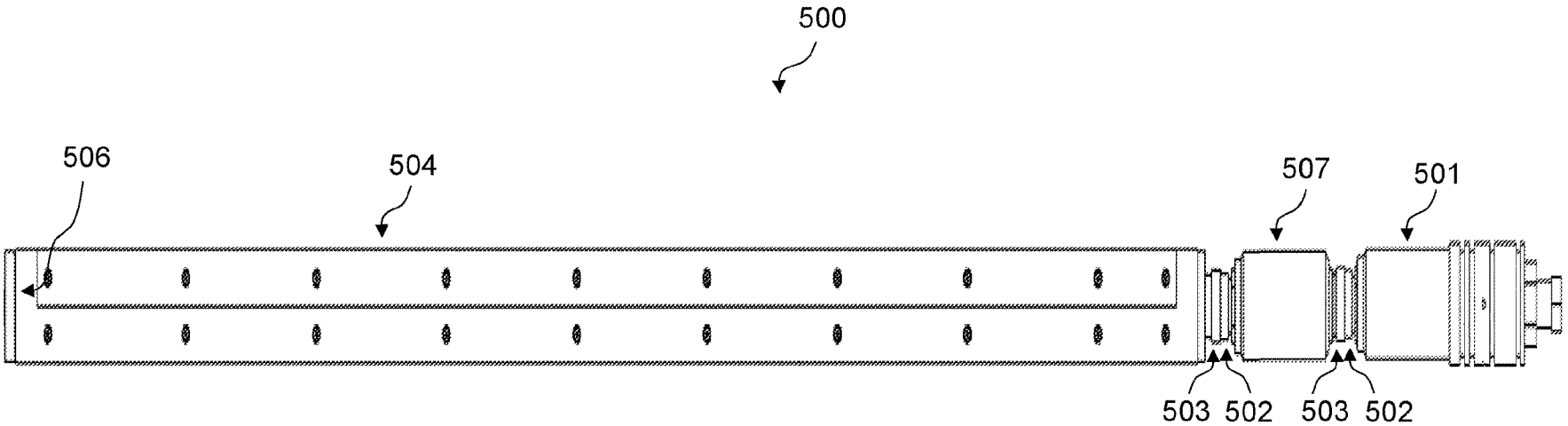
FIG. 5 is an alternative embodiment of the toolstring shown in FIG. 1B.

FIG. 5 shows an alternative toolstring embodiment 500 in which the EM transceiver circuitry is incorporated in a separate module 507 equipped with the same 2-part multi-pole connectors 502, 503 at either end. The EM transceiver module 507 is sandwiched between the pressure and temperature transducer 501 and battery carrier 504. All other parts remain the same as described for toolstring 400 shown in FIG. 4, including electrical socket 506.

It should be appreciated that in other embodiments, additional sensors can be integrated into pressure and temperature gauge 401, 501, or incorporated as separate modules between pressure and temperature transducer gauge 501 and a separate EM transceiver module 507, and connected together using suitable multi-pole electrical connectors.

Hence, embodiments of the present invention address or at least ameliorate one or more of the aforementioned problems of the prior art by positioning the toolstring with an "external gap" outside the gap sub such that full-bore access through the gap sub is provided. Since the toolstring is not positioned inside the gap sub fluid production rates are not hindered by the toolstring. Also, the toolstring positioned outside the gap sub is not exposed to corrosion, abrasion risk and/or erosion risk from the fluids in the gap sub. Further, by providing full-bore access through the gap sub, it is possible to circulate fluids down through the end of the tubing string to aid wellbore clean-up operations. Yet further, electrical isolation of the drill string is improved compared with at least some of the prior art solutions, thus reducing losses and improving the quality of the EM telemetry.

The reference to any prior art in this specification is not, and should not be taken as, an acknowledgement or any form of suggestion that the prior art forms part of the common general knowledge.

In this specification, adjectives such as first and second, and the like may be used solely to distinguish one element or action from another element or action without necessarily requiring or implying any actual such relationship or order. Where the context permits, reference to an integer or a component or step (or the like) is not to be interpreted as being limited to only one of that integer, component, or step, but rather could be one or more of that integer, component, or step etc.

In this specification, the terms "comprises", "comprising" or similar terms are intended to mean a non-exclusive inclusion, such that an apparatus that comprises a list of elements does not include those elements solely, but may well include other elements not listed.

Throughout the specification the aim has been to describe the invention without limiting the invention to any one embodiment or specific collection of features. Persons skilled in the relevant art may realize variations from the specific embodiments that will nonetheless fall within the scope of the invention as defined by the accompanying claims.

The invention claimed is:

1. A gap sub for wellbore fluids, the gap sub comprising:

an electrical isolation structure to electrically isolate two metallic ends of the gap sub;

a housing mounted outside of the gap sub, the housing accommodating an "external gap", and a toolstring for acquiring in-situ measurements of wellbore and near-wellbore conditions and transmitting the in-situ measurements to surface using electromagnetic (EM) telemetry; and an antenna rod connected to the "external gap" in the housing, and the antenna rod straddling the electrical isolation structure in the gap sub to be electrically isolated from one metallic end of the two metallic ends of the gap sub and electrically coupled to another metallic end of the two metallic ends of the gap sub.

2. The gap sub of claim 1, wherein the toolstring comprises:

one or more electronic sensors able to measure the wellbore and near-wellbore conditions;

an EM transceiver for encoding measurements from the one or more electronic sensors, modulating an EM waveform and transmitting the EM waveform to the surface; and a power source, such as a battery pack, to provide electrical power to the one or more electronic sensors and the EM transceiver.

3. The gap sub of claim 2, wherein the one or more electronic sensors are integrated with the EM transceiver in a single module or provided in separate modules that can be coupled together.

4. The gap sub of claim 3, wherein the single module comprising the one or more electronic sensors comprises a shoulder that presses against an internal lip of the housing under wellbore fluid pressure to rigidly secure the toolstring inside the housing.

5. The gap sub of claim 1, wherein the housing is in a form of a pressure housing comprising a pressure transducer at an upper end of the pressure housing.

6. The gap sub of claim 1, wherein, the "external gap" is in a form of an adjustable antenna isolator assembly adjustably accommodated at least partly within a lower end of a pressure housing.

7. The gap sub of claim 6, wherein the adjustable antenna isolator assembly is attached to a first end of the antenna rod at the one metallic end of the gap sub and electrically isolated from the housing.

8. The gap sub of claim 7, wherein a second end of the antenna rod is coupled to the other metallic end of the gap sub via a conductive element.

9. The gap sub of claim 6, wherein the adjustable antenna isolator assembly is accommodated at least partly within the pressure housing to enable fine adjustment of an axial position of the adjustable antenna isolator assembly in the pressure housing.

10. The gap sub of claim 9, wherein the fine adjustment is achieved with external threads on an outer collar of the adjustable antenna isolator assembly engaging with internal threads in the pressure housing.

11. The gap sub of claim 1, wherein the housing comprises one or more ports to bleed-off trapped pressure inside the housing when the gap sub is retrieved to the surface.

12. The gap sub of claim 11, wherein an adjustable antenna isolator assembly comprises one or more seals, wherein fine adjustment of an axial position of the adjustable antenna isolator assembly in a pressure housing until the one or more seals clear the one or more ports provides a vent mechanism to bleed-off the trapped pressure inside the pressure housing.

13. The gap sub of claim 1, wherein the gap sub provides full-wellbore access, with a pressure housing mounted on an exterior surface of the gap sub.

14. The gap sub of claim 1, wherein the gap sub comprises upper and lower metal tubes and the electrical isolation structure is in a form of a hollow composite electrical isolation collar in between the upper and lower metal tubes.

15. The gap sub claim 1, wherein the gap sub comprises an assembly for creating an electrical connection between a transmit/receive line on an EM transceiver with the one metallic end of the gap sub.

16. The gap sub of claim 1, wherein the gap sub comprises an assembly for establishing an electrical connection between a ground plane on an EM transceiver with the other metallic end of the gap sub.

17. The gap sub of claim 1, wherein the gap sub comprises threaded pin and/or box connections at either the one metallic end or the other metallic end of the gap sub, configured to be inserted at a desired position within a tubing string.

18. The gap sub of claim 17, wherein the gap sub comprises a thread locking compound applied to threads of the threaded pin and/or box connections to ensure torque rating of the gap sub equals or exceeds the torque rating of the tubing string above and below the gap sub.

19. A method of acquiring in-situ measurements of wellbore and near-wellbore conditions and transmitting the in-situ measurements to surface using an electromagnetic (EM) telemetry, the method comprising:

providing a gap sub between tubing joints in a tubing string for wellbore fluids, the gap sub comprising an electrical isolation structure to electrically isolate two metallic end members of the gap sub;

mounting a housing outside of the gap sub, the housing accommodating an "external gap" and a toolstring for the EM telemetry; and connecting an antenna rod to the "external gap" to electrically isolate the antenna rod from one metallic end member of the two metallic end members, and the antenna rod straddling the electrical isolation structure in the gap sub, with another metallic end member of the two metallic end members of the antenna rod mechanically and electrically connected to the other metallic end member.

20. A system to acquire in-situ measurements of wellbore and near-wellbore conditions and transmitting the in-situ measurements to surface using an electromagnetic (EM) telemetry, the system comprising:

a gap sub between tubing joints in a tubing string for wellbore fluids, the gap sub comprising an electrical isolation structure to electrically isolate two metallic ends of the gap sub;

a housing mounted outside of the gap sub, the housing accommodating an "external gap" and a toolstring providing the EM telemetry; and an antenna rod connected to the "external gap", and the antenna rod straddling the electrical isolation structure in the gap sub to be electrically isolated from one metallic end of the two metallic ends of the gap sub and electrically coupled to another metallic end of the two metallic ends of the gap sub.

21. The system of claim 20, wherein the system comprises one or more of following:

the toolstring comprises one or more electronic sensors able to measure the wellbore and near-wellbore conditions, an EM transceiver for encoding measurements from the one or more electronic sensors, modulating an EM waveform and transmitting the EM waveform to the surface, and a power source, such as a battery pack, to provide electrical power to the one or more electronic sensors and the EM transceiver;

the one or more electronic sensors are integrated with the EM transceiver in a single module or provided in separate modules that can be coupled together;

the single module comprising the one or more electronic sensors comprises a shoulder that presses against an internal lip of the housing under wellbore fluid pressure to rigidly secure the toolstring inside the housing;

the housing is in a form of a pressure housing comprising a pressure transducer at an upper end of the pressure housing;

the "external gap" is in a form of an adjustable antenna isolator assembly adjustably accommodated at least partly within a lower end of the pressure housing, wherein, optionally:

the adjustable antenna isolator assembly is attached to a first end of the antenna rod at the one metallic end of the gap sub and electrically isolated from the housing;

a second end of the antenna rod is coupled to the other metallic end of the gap sub via a conductive element;

the adjustable antenna isolator assembly is accommodated at least partly within the pressure housing to enable fine adjustment of an axial position of the adjustable antenna isolator assembly in the pressure housing, the fine adjustment is optionally achieved with external threads on an outer collar of the adjustable antenna isolator assembly engaging with internal threads in the pressure housing;

the housing comprises one or more ports to bleed-off trapped pressure inside the housing when the gap sub is retrieved to the surface;

the adjustable antenna isolator assembly comprises one or more seals, wherein the fine adjustment of the axial position of the adjustable antenna isolator assembly in the pressure housing until the one or more seals clear the one or more ports provides a vent mechanism to bleed-off the trapped pressure inside the pressure housing;

the gap sub provides full-wellbore access, with the pressure housing mounted on an exterior surface of the gap sub;

the gap sub comprises upper and lower metal tubes and the electrical isolation structure is in a form of a hollow composite electrical isolation collar in between the upper and lower metal tubes;

the gap sub comprises a first assembly for creating an electrical connection between a transmit/receive line on the EM transceiver with the one metallic end of the gap sub;

the gap sub comprises a second assembly for establishing an electrical connection between a ground plane on the EM transceiver with the other metallic end of the gap sub;

the gap sub comprises threaded pin and/or box connections at either the one metallic end or the other metallic end of the gap sub, configured to be inserted at a desired position within a tubing string; and the gap sub comprises a thread locking compound applied to threads of the threaded pin and/or box connections to ensure torque rating of the gap sub equals or exceeds the torque rating of the tubing string above and below the gap sub.

* * * * *